US006269488B1

(12) United States Patent
Jurgensen et al.

(10) Patent No.: US 6,269,488 B1
(45) Date of Patent: Aug. 7, 2001

(54) HEADBAND APPARATUS AND METHOD OF MAKING

(76) Inventors: Marilyn Jurgensen, 6812 W. 6th St., Sioux Falls, SD (US) 57107; Tracy Wehrkamp, 7800 E. Callies Pl., Sioux Falls, SD (US) 57110

( * ) Notice: Subject to any disclaimer, the term of this patent is extended or adjusted under 35 U.S.C. 154(b) by 0 days.

(21) Appl. No.: 09/514,444

(22) Filed: Feb. 28, 2000

(51) Int. Cl.[7] ..... A42B 19/02
(52) U.S. Cl. ..... 2/171; 132/273
(58) Field of Search ..... 2/144, 171, 181, 2/DIG. 11; 132/54, 273, 275

(56) References Cited

U.S. PATENT DOCUMENTS

| | | | | |
|---|---|---|---|---|
| D. 133,497 | | 8/1942 | Ross . | |
| D. 351,052 | | 10/1994 | Russell . | |
| D. 357,343 | | 4/1995 | O'Neal et al. . | |
| 1,481,778 | | 1/1924 | Salomons . | |
| 2,011,194 | * | 8/1935 | Eisler | 132/273 |
| 2,567,119 | | 9/1951 | Naidor . | |
| 4,600,029 | | 7/1986 | Ueberschaar . | |
| 4,742,581 | * | 5/1988 | Rosenthal | 2/181 |
| 4,819,671 | | 4/1989 | Walker . | |
| 5,230,355 | * | 7/1993 | Weingrod | 132/275 |
| 5,337,763 | | 8/1994 | Haber et al. . | |
| 5,426,788 | | 6/1995 | Meltzer . | |
| 5,456,274 | * | 10/1995 | Selbee et al. | 132/275 |
| 5,551,452 | | 9/1996 | Barlow . | |
| 5,881,736 | * | 3/1999 | Turner et al. | 132/200 |
| 5,915,532 | * | 6/1999 | Williams | 2/171 |

FOREIGN PATENT DOCUMENTS

| | | | | |
|---|---|---|---|---|
| 0797281 | * | 4/1936 | (FR) | 132/273 |

* cited by examiner

*Primary Examiner*—John J. Calvert
*Assistant Examiner*—Katherine Moran

(57) ABSTRACT

A headband apparatus and method of making for securing a headband on the head in such a way as to avoid twisting the headband while it is positioned on the wearer's head. The headband apparatus further provides an aesthetically pleasing hair enhancement for the wearer. The headband apparatus and method of making includes a headband portion attached at opposite ends to an elastic member which extends through the length of a covering member. The method of making provides a method of stitching the elastic and covering assembly so that the inelastic portion of the headband remains flat while on the head of the wearer.

12 Claims, 2 Drawing Sheets

HEADBAND APPARATUS AND METHOD OF MAKING

BACKGROUND OF THE INVENTION

1. Field of the Invention

The present invention relates to devices to be worn on the head and the methods of making such and more particularly pertains to a new headband apparatus and method of making for securing the headband material in such a way as to avoid twisting while it is encircled on the wearer's head as well as providing an aesthetically pleasing hair enhancement for the wearer.

2. Description of the Prior Art

The use of devices to be worn on the head and the methods of making such are known in the prior art. More specifically, devices to be worn on the head and the methods of making such heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,551,452; 4,819,671; 2,567,119; 5,230,355, 5,337,763; 4,600,029; 1,481,778; 5,426,788; U.S. Pat. No. Des. 357,343, U.S. Pat. No. Des. 351,052 and U.S. Pat. No. Des. 133,497.

While these devices fulfill their respective, particular objectives and requirements, the aforementioned patents do not disclose a new headband apparatus and method of making. The inventive device includes a headband portion of inelastic material attached at opposite ends by an elastic member which extends thorough the length of a covering member. The present invention further includes the method of stitching the elastic and covering assembly so that the inelastic portion of the headband remains flat while on the head of the wearer.

In these respects, the headband apparatus and method of making according to the present invention substantially departs from the conventional concepts and designs of the prior art, and in so doing provides an apparatus primarily developed for the purpose of securing the headband material in such a way as to avoid twisting while it is positioned on the wearer's head as well as providing an aesthetically pleasing hair enhancement for the wearer.

SUMMARY OF THE INVENTION

In view of the foregoing disadvantages inherent in the known types of devices to be worn on the head and the methods of making such now present in the prior art, the present invention provides a new headband apparatus and method of making wherein the same can be utilized for securing the headband material in such a way as to avoid twisting while it is encircled on the wearer's head as well as providing an aesthetically pleasing hair enhancement for the wearer.

The general purpose of the present invention, which will be described subsequently in greater detail, is to provide a new headband apparatus and method which has many of the advantages of the devices to be worn on the head and the methods of making such mentioned heretofore and many novel features that result in a new headband apparatus and method of making such which is not anticipated, rendered obvious, suggested, or even implied by any of the prior art devices to be worn on the head and the methods of making such, either alone or in any combination thereof.

To attain this, the present invention generally comprises a headband portion of inelastic material attached at opposite ends to an elastic member which extends through the length of a covering member. The invention further comprises the method of making the inventive device by stitching the elastic and covering assembly so that the inelastic portion of the headband remains flat while on the head of the wearer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new headband apparatus and method which has many of the advantages of the devices to be worn on the head and the methods of making such mentioned heretofore and many novel features that result in a new headband apparatus and method which is not anticipated, rendered obvious, suggested, or even implied by any of the prior art devices to be worn on the head and the methods of making such, either alone or in any combination thereof.

It is another object of the present invention to provide a new headband apparatus and method of making which may be easily and efficiently manufactured and marketed.

It is a further object of the present invention to provide a new headband apparatus and method of making which is of a durable and reliable construction.

An even further object of the present invention is to provide a new headband apparatus and method of making which is susceptible of a low cost of manufacture with regard to both materials and labor, and which accordingly is then susceptible of low prices of sale to the consuming public, thereby making such headband apparatus and method of making economically available to the buying public.

Still yet another object of the present invention is to provide a new headband apparatus and method of making which provides in the apparatuses and methods of the prior art some of the advantages thereof, while simultaneously overcoming some of the disadvantages normally associated therewith.

Still another object of the present invention is to provide a new headband apparatus and method of making for securing the headband material in such a way as to avoid twisting while it is positioned on the wearer's head as well as providing an aesthetically pleasing hair enhancement for the wearer.

Yet another object of the present invention is to provide a new headband apparatus and method of making which includes a headband portion of inelastic material attached at opposite ends to an elastic member which extends through the length of a covering member and the method of stitching the elastic and covering assembly so that the inelastic portion of the headband remains flat while on the head of the wearer.

Still yet another object of the present invention is to provide a new headband apparatus and method of making that permits the wearer to have a headband apparatus that can appear to enhance the appearance of the wearer's own hair.

Even still another object of the present invention is to provide a new headband apparatus and method of making that enhances the aesthetic appearance of the headband by remaining flat due to the method of making the headband apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
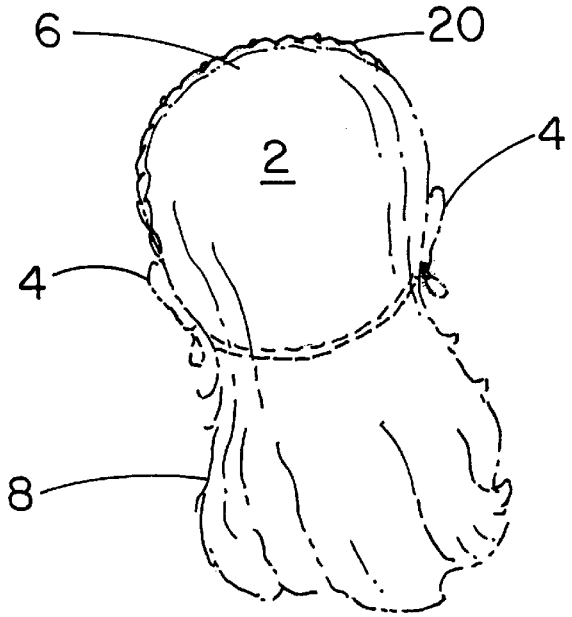
FIG. 1 is a perspective view of a new headband apparatus according to the present invention.
Figure 2:
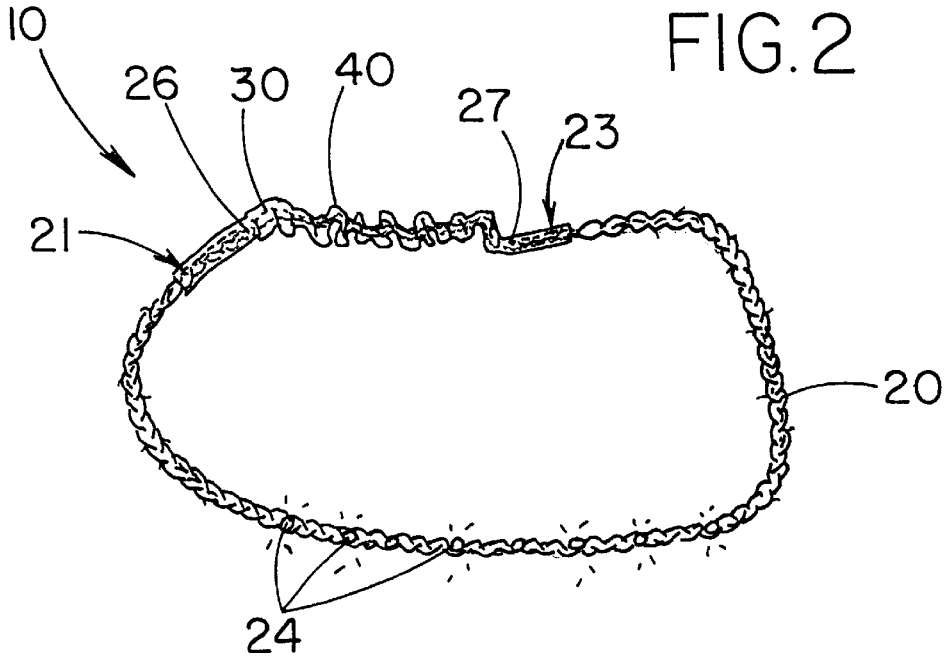
FIG. 2 is a perspective view on an embodiment of the present invention.

With reference now to the drawings, and in particular to FIGS. 1 through 4 thereof, a new headband apparatus and method of making embodying the principles and concepts of the present invention and generally designated by the reference numeral 10 will be described.

As best illustrated in FIGS. 1 through 4, the headband apparatus 10 generally comprises a headband portion 20, an elastic band 30 for coupling the ends of the headband portion 20, and a covering member 40 for encasing the elastic band 30.

The headband portion 20 is designed for positioning on a head 2 of a wearer such that said the headband portion 20 extends substantially between ears 4 of the wearer and over a crown 6 of the head of the wearer.

The elastic band 30 is coupled to the headband portion 20 such that the elastic band 30 extends between opposite ends 26 and 27 of said headband portion 20. The elastic band 30 is designed for positing to extend along a back of the head 2 of the wearer. In an embodiment, the length of the elastic band 30 is approximately six (6) inches.

The covering member 40 is generally tube-shaped and includes opposite ends 42 and 43 coupled to the headband portion 20 such that the covering member 40 extends between the opposite ends 26 and 27 of the headband portion 20. Ideally, the covering member 40 is approximately sixteen (16) inches in length for an adult wearer and approximately fifteen (15) inches in length for a youth wearer. The covering member 40 is also ideally two and one-fourth (2¼) inches in width. The elastic band 30 extends through an interior of the covering member such that the covering member 40 covers the elastic band 30.

In an embodiment, the headband portion 20 is a length of braided inelastic decorative material 22. In an embodiment of the invention, (see FIG. 1), the braided inelastic material 22 is designed to closely resemble human hair. The braided inelastic material 22 may include a plurality of beads 24 that are interlaced into the braided material 22. The beads 24 are positioned to be visible when the headband portion 20 extends across the head 2 of the wearer.

The length of braided material 22 may be colored to resemble human hair of the wearer 8 such that the headband portion 20 appears to be part of the hair of the wearer 8.

In another embodiment of the invention, the length of the braided material 22 may be colored to resemble human hair such that the headband portion 20 is designed to contrast with the hair of the wearer 8.

In an embodiment of the invention (see FIG. 4), the headband portion 20 comprises a length of inelastic decorative material 25 such that the headband portion 20 contrasts with both the color and the appearance of the hair of the wearer 8.

In an embodiment the covering member 40 includes a length greater than a fully extended length of the elastic band 30 such that the covering member 40 provides a plurality of folds 44 along the length of the covering member 40 when the elastic band 30 is in less than a fully extended position. Ideally, the covering member is made of a silk fabric.

Figure 3:
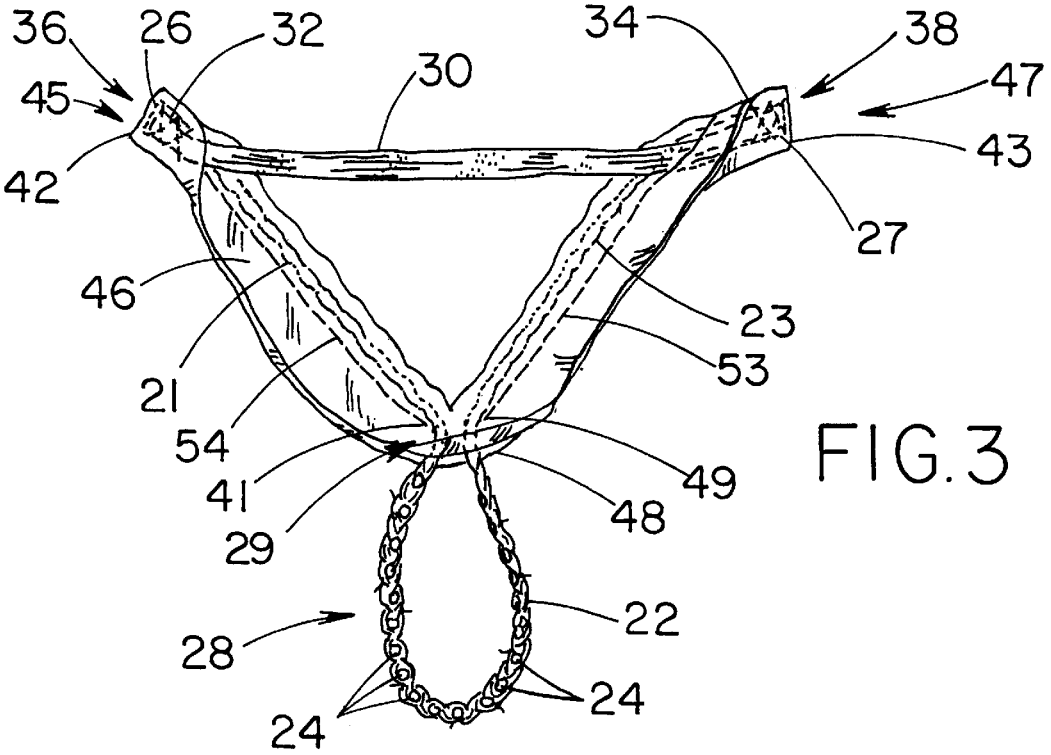
FIG. 3 is a perspective view of an embodiment of the present invention during construction of the invention.
Figure 4:
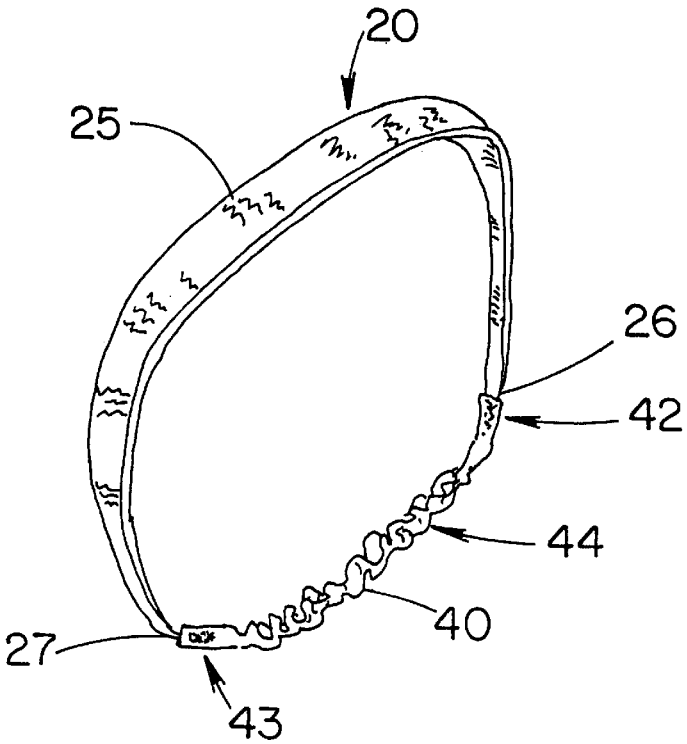
FIG. 4 is an embodiment of the present invention showing the headband apparatus with an alternate headband material.

The method of making the headband apparatus includes the steps of attaching the elastic band 30 to the covering member 40, attaching the covering member 40 to the headband portion 20, and pulling the headband portion 20 through the covering member 40 (see FIG. 3).

The materials necessary for the method include an elongated piece of covering material 46 for the covering member 40, the headband portion 20 having a length greater than a longitudinal length of the covering material 46, and an elastic band 30 having an unextended length less than the longitudinal length of the covering material.

The covering material 46 is placed in a flat position and the opposite ends 26 and 27 of the headband portion 20 are aligned with associated opposite ends 42 and 43 of the covering material 46 such that end portions 21 and 23 of the headband portion 20 extend inwardly from the opposite ends 42 and 43 of the covering material 46 and a medial portion 28 of the headband portion 20 extends outwardly over a longitudinal edge 48 of the covering material 46.

Then, the covering material 46 is folded over the end portions 21 and 23 of the headband portion 20.

The folded opposite ends 26 and 27 are stitched with the covering material 46 to form opposite stitched ends 45 and 47 so that each of the opposite ends 26 and 27 of the headband portion 20 is coupled between an associated folded opposite end 42 or 43 of the covering material 46.

Each of the opposite ends 42 and 43 of the covering material 46 is stitched inwardly along a middle of the folded covering material to form aligned longitudinal stitch lines 53 and 54. Thus, the end portions 21 and 23 of the headband portion 20 are positioned within the folded covering material and the medial portion 28 of the headband portion 20 extends outwardly through a gap 29 between the interior ends 41 and 49 of stitch lines 53 and 54.

The opposite ends 32 and 34 of the elastic band 30 are aligned with the associated one of the opposite stitched ends 45 and 47 of the covering material 46.

Each of the stitched ends 45 and 47 of the covering material 46 are generally folded along the longitudinal stitch line 53 and 54 such that the opposite ends 32 and 34 of the elastic band 30 are positioned between the folded stitched ends of the covering material.

The folded stitched ends are stitched such that each of the opposite stitched ends 36 and 38 of the elastic band are coupled to an associated one of the folded stitched ends of the covering material.

Thus, by pulling the headband portion 20 through the gap 29 between the interior ends of the stitch lines, the covering material is turned inside out such that the elastic band 30 is positioned within the covering material 46 and the headband portion 20 positioned outside the covering member 40 extends between the stitched ends of the covering member 40.

In use the headband apparatus may be placed on the head of the wearer in several different manners, either keeping back all of the hair of the wearer, or as part of another aesthetic hair display. The multiple embodiments of the invention allow the wearer to have a variety of different appearances when using the headband apparatus, either matching the hair of the wearer, or contrasting from the hair of the wearer, or having an altogether different hair band material in the hairband portion. The method of making the hairband apparatus permits the hairband portion of the invention to lie flat on the head of the wearer without twisting or otherwise affecting the appearance of the hairband.

As to a further discuss ion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A headband apparatus comprising:

a headband portion adapted for positioning on a head of a wearer, said headband portion having opposite ends;

an elastic band, said elastic band being coupled to said headband portion such that elastic band extends between said opposite ends of said headband portion such that said headband portion and said elastic band form a loop whereby said headband portion extends substantially between ears of the wearer and over a crown of the head of the wearer and said elastic band is adapted for positioning to extend along a back of the head of the wearer; and a covering member coupled to said headband portion such that said covering member extends between said opposite ends of said headband portion, said elastic band extending through said covering member whereby said covering member covers said elastic band.

2. The headband apparatus of claim 1, further comprising:

said headband portion being a length of a braided material.

3. 1he headband apparatus of claim 2, further comprising:

a plurality of beads being interlaced into said braided material such that said beads are positionable to be visible when said headband apparatus is worn by the wearer.

4. The headband apparatus of claim 2, further comprising:

said length of braided material resembling human hair of the wearer whereby said headband portion is adapted for appearing to be part of the hair of the wearer.

5. The headband apparatus of claim 4, further comprising:

said length of braided material resembling human hair of the wearer, said length of braided material being colored in contrast to a hair color of the wearer.

6. The headband apparatus of claim 1, further comprising:

said headband portion being a length of inelastic decorative material.

7. The headband apparatus of claim 1, further comprising:

said covering member having a length greater than a fully extended length of said elastic band whereby said covering member provides a plurality of folds along said length of said covering member when said elastic band is in less than a fully extended position.

8. A headband apparatus comprising:

a headband portion adapted for positioning on a head of a wearer such that said headband portion extends substantially between ears of the wearer and over a crown of the head of the wearer;

an elastic band, said elastic band being coupled to said headband portion such that said elastic band extends between opposite ends of said headband portion, said elastic band being adapted for positioning to extend along a back of the head of the wearer;

a generally tube-shaped covering member having opposite ends coupled to said headband portion such that said covering member extends between said opposite ends of said headband portion, said elastic band extending through an interior of said covering member whereby said covering, member covers said elastic band;

said headband portion being a length of braided inelastic decorative material;

a plurality of beads being interlaced into said braided material such that said beads are positionable to be visible when said headband portion extends across the head of the wearer;

said length of braided material resembling human hair of the wearer whereby said headband portion is adapted for appearing to be part of the hair of the wearer; and said covering member having a length greater than a fully extended length of said elastic band whereby said covering member provides a plurality of folds along said length of said covering member when said elastic band is in less than a fully extended position.

9. A method of making a headband apparatus, the steps of the method comprising:

providing an elongated piece of covering material, a headband portion having a length greater than a longitudinal length of said covering material, and an elastic band having an unextended length less than said longitudinal length of said covering, material;

positioning said covering material such that said covering material is in a flat position;

aligning opposite ends of said headband portion with associated opposite ends of said covering material such that end portions of said headband portion extend inwardly from said opposite ends of said covering material and a medial portion of said headband portion extends outwardly over a longitudinal edge of said covering material;

folding said covering material over said end portions of said headband portion;

stitching said folded opposite ends of said covering material to form opposite stitched ends of said covering material such that each of said opposite ends of said headband portion is coupled between an associated folded opposite end of said covering material;

stitching inwardly from each of said opposite ends of said covering material along a middle of said folded covering material to form aligned longitudinal stitch lines such that said end portions of said headband portion are positioned within said folded covering material and said medial portion of said headband portion extends outwardly through a gap between interior ends of each of said stitch lines;

aligning opposite ends of said elastic band with said an associated one of said opposite stitched ends of said covering material;

folding each of said stitched ends of said covering material generally along said longitudinal stitch line whereby said opposite ends of said elastic band are positioned between said folded stitched ends of said covering material;

stitching said folded stitched ends whereby each of said opposite stitched ends of said elastic band are coupled to an associated one of said folded stitched ends of said covering material; and pulling said headband portion through said gap between said interior ends of said stitch lines such that said covering material is turned inside out whereby said elastic band is positioned within said covering material and said headband portion positioned outside said covering member such that said headband portion extends between said stitched ends of said covering member.

10. The method of claim 9, the steps of the method further comprising:

stitching a closing stitch line across said gap between said interior ends of said stitch lines whereby said elastic band is scaled within said covering member.

11. The headband apparatus produced by the method of claim 9.

12. The headband apparatus produced by the method of claim 10.

* * * * *